US011598541B2

(12) United States Patent
Cho et al.

(10) Patent No.: US 11,598,541 B2
(45) Date of Patent: Mar. 7, 2023

(54) POWERLESS HUMIDIFICATION MODULE FOR AIR CLEANER CAPABLE OF PREVENTING LEAKAGE OF WATER

(71) Applicant: COWAY CO., LTD., Gongju-si (KR)

(72) Inventors: An Ho Cho, Seoul (KR); Hyun Jin Hong, Seoul (KR); Sang Woo Kang, Seoul (KR)

(73) Assignee: Coway Co., Ltd., Gongju-si (KR)

( * ) Notice: Subject to any disclaimer, the term of this patent is extended or adjusted under 35 U.S.C. 154(b) by 345 days.

(21) Appl. No.: 16/628,748

(22) PCT Filed: Jul. 4, 2018

(86) PCT No.: PCT/KR2018/007572
§ 371 (c)(1),
(2) Date: Jan. 6, 2020

(87) PCT Pub. No.: WO2019/009614
PCT Pub. Date: Jan. 10, 2019

(65) Prior Publication Data

US 2020/0284454 A1 Sep. 10, 2020

(30) Foreign Application Priority Data

Jul. 7, 2017 (KR) ..... 10-2017-0086609

(51) Int. Cl.
*F24F 11/00* (2018.01)
*F24F 6/12* (2006.01)
(Continued)

(52) U.S. Cl.
CPC ..... *F24F 11/0008* (2013.01); *F24F 6/12* (2013.01); *F24F 8/10* (2021.01); *F24F 8/117* (2021.01);
(Continued)

(58) Field of Classification Search
CPC ..... F24F 2006/008; F24F 6/043
See application file for complete search history.

(56) References Cited

U.S. PATENT DOCUMENTS 5,578,113 A * 11/1996 Glenn ..... F24F 8/10 96/57
2002/0070465 A1* 6/2002 Harvel ..... F24F 6/04 261/36.1
(Continued)

FOREIGN PATENT DOCUMENTS

CN 2681018 Y 2/2005
CN 104566743 A 4/2015
(Continued)

OTHER PUBLICATIONS

Extended European Search Report dated Feb. 10, 2021 for European Application No. 18827940.0; 10 Pages.
(Continued)

*Primary Examiner* — Schyler S Sanks
(74) *Attorney, Agent, or Firm* — Daly Crowley Mofford & Durkee, LLP

(57) ABSTRACT

Disclosed is a powerless humidification module for an air cleaner which is capable of preventing leakage of water into the air cleaner. A powerless humidification module for an air cleaner which is detachably mounted on an upper portion of a body of the air cleaner and is capable of preventing leakage of water includes a base cover having a first opening opened toward the air cleaner and a second opening opened toward a side surface of the first opening, a cistern part located in the interior of the base cover and located such that a space defined between an inner partition wall and an outer partition wall having predetermined heights such that water supplied to one side thereof is stored surrounds a periphery of the first opening whereby water supplied to one side
(Continued)

thereof is stored, and a humidification filter located in the second opening.

8 Claims, 5 Drawing Sheets

(51) Int. Cl.

| | |
|---|---|
| ***F24F 13/20*** | (2006.01) |
| ***F24F 13/28*** | (2006.01) |
| ***F24F 8/10*** | (2021.01) |
| ***F24F 8/117*** | (2021.01) |
| ***F24F 6/00*** | (2006.01) |

(52) U.S. Cl.
CPC ..... *F24F 13/20* (2013.01); *F24F 13/28* (2013.01); *F24F 2006/008* (2013.01)

(56) References Cited

U.S. PATENT DOCUMENTS

| | | | | |
|---|---|---|---|---|
| 2004/0070091 | A1* | 4/2004 | Rotering | F24F 6/025 261/70 |
| 2009/0107530 | A1* | 4/2009 | Kougami | G03D 3/13 134/122 R |

FOREIGN PATENT DOCUMENTS

| | | | | |
|---|---|---|---|---|
| CN | 104990137 | A | 10/2015 | |
| JP | S 61134531 | A | 6/1986 | |
| JP | H 1163584 | A | 3/1999 | |
| JP | 2011-226670 | A | 11/2011 | |
| JP | 2015-075248 | A | 4/2015 | |
| KR | 10-2012-0026910 | A | 3/2012 | |
| KR | 10-1433288 | B1 | 8/2014 | |
| KR | 10-2016-0025968 | A | 3/2016 | |
| KR | 10-2017-0043314 | A | 4/2017 | |
| WO | WO 2005/057088 | A1 | 6/2005 | |
| WO | WO-2012091369 | A2 * | 7/2012 | F24F 6/043 |

OTHER PUBLICATIONS

Chinese First Office Action (with Machine English Translation from Espacenet.com) dated Nov. 2, 2020 for Chinese Application No. 2018-80045572.8; 15 Pages.

Japanese Office Action (with Machine English Translation from Espacenet.com) dated Jan. 5, 2021 for Japanese Application No. 2020-500632; 8 Pages.

International Search Report (with English Translation) dated Oct. 18, 2018 for International Application No. PCT/KR2018/007572; 4 Pages.

* cited by examiner

POWERLESS HUMIDIFICATION MODULE FOR AIR CLEANER CAPABLE OF PREVENTING LEAKAGE OF WATER

CROSS REFERENCE TO RELATED APPLICATIONS

This present application is a national stage filing under 35 U.S.C § 371 of PCT application number PCT/KR2018/007572 filed on Jul. 4, 2018 which is based upon and claims the benefit of priority to Korean Patent Application No. 10-2017-0086609 filed on Jul. 7, 2017 in the Korean Intellectual Property Office. The disclosures of the above-listed applications are hereby incorporated by reference herein in their entirety.

TECHNICAL FIELD

The present invention relates to a humidification module, and more particularly to a powerless humidification module for an air cleaner which is installed in an air cleaner and is capable of preventing leakage of water into the air cleaner.

BACKGROUND ART

An air cleaner having a general humidification function can perform air purification and humidification by using an air purification filter and a humidification unit installed in the interior of a device.

However, according to a humidification cleaner of a conventional technology, when a humidification function is not used, a humidification filter installed in the interior of the device has to be separated, and thus it is bothersome to use the humidification cleaner and the size of the device increases as the number of parts installed in the interior of the device increases.

Further, because the humidification cleaner of the conventional technology is disposed in the interior of the device, the humidified air is supplied to the interior via the interior of the device and thus the humidification degree is low.

In an effort to solve the above-described problems, in patent document 1 of the applicant discloses a powerless humidification device for an air cleaner that can be separated from an air cleaner without being integrally formed with the air cleaner and can be mounted on various kinds of air cleaners with a simple structure.

The humidification device may be easily mounted on various types of air cleaners and thus may humidifies an interior by using air discharged from the air cleaner without using a separate power supply, but water in the interior of the humidification device may be introduced into the air cleaner as the humidification device is detachably mounted on the air cleaner.

When the water leaked from the humidification device is introduced into the interior of the air cleaner, the electric parts located in the interior of the air cleaner may break down and a short circuit accident may occur according to occasions, and it may be considered that a waterproof member, such as rubber, is interposed in an attachment/detachment part to prevent the problem, but the waterproof member formed of a material such as rubber may deteriorate the easiness of attachment of the humidification module.

(Patent Document 1) Patent document 1: KR 2017-0043314 A

DISCLOSURE

Technical Problem

The present invention has been made in an effort to overcome the above-described problems, and provides a powerless humidification module for an air cleaner that may prevent leakage of water into an air cleaner.

Technical Solution

In accordance with an aspect of the present invention, there is provided a powerless humidification module for an air cleaner which is detachably mounted on an upper portion of a body of the air cleaner and is capable of preventing leakage of water, humidification module including: a base cover having a first opening opened toward the air cleaner and a second opening opened toward a side surface of the first opening; a cistern part located in the interior of the base cover and located such that a space defined between an inner partition wall and an outer partition wall having predetermined heights such that water supplied to one side thereof is stored surrounds a periphery of the first opening whereby water supplied to one side thereof is stored; and a humidification filter located in the second opening.

The humidification module may further include a protector located in the interior of the base cover to communicate the first opening and the second opening and located to cover an upper portion of the first opening.

The protector may include: an upper prevention wall located to cover the upper portion of the first opening; and a guide wall extending from an outer periphery of the upper prevention wall to the space of the cistern part.

The humidification module may further include a drain hole formed on one side of the base cover, and when the water supplied to one side space of the cistern part overflows a predetermined height of an overflow recess formed in the outer partition wall, the water may be discharged through the drain hole, overflowing the outer partition wall through the overflow recess.

The humidification module may further include a partition wall which has a height such that the space, in which the water of the cistern part is stored, is divided into one side space and an opposite side space, and when the water supplied to one side space of the cistern part overflows a predetermined height of an overflow recess formed in the partition wall, the water may be introduced into the opposite side space of the cistern part, overflowing the partition wall through the overflow recess.

The humidification module may further include a drain hole formed on one side of the base cover, and when the water introduced to the opposite side space of the cistern part overflows a predetermined height of an overflow recess formed in the outer partition wall, the water may be discharged through the drain hole overflowing the outer partition wall through the overflow recess.

The humidification module may further include a sensor configured to detect the level of the water stored in the space of the cistern part.

Advantageous Effects

According to the powerless humidification module for an air cleaner that may prevent leakage of water according to the present invention, overflowing of water into the interior of the air cleaner and introduction of water when the water is supplied can be prevented, a predetermined amount of water that is necessary for humidification can be adjusted, and the humidification module can be easily attached to and detached from the air cleaner.

BEST MODE

The objectives, features, and other advantages of the present invention will be more apparent by describing exemplary embodiments of the present invention in detail with reference to the accompanying drawings. It should be noted that the drawings are not to precise scale and may be exaggerated in thickness of lines or size of components for descriptive convenience and clarity. In addition, the terms used herein are defined by taking functions of the present invention into account and can be changed according to user or operator custom or intention. Therefore, definition of the terms should be made according to the overall disclosure set forth herein.

Further, the embodiments are provided exemplarily for description of the present invention, and are not intended to limit the technical scope of the present invention.

The elements constituting the humidification module capable of preventing leakage of water of an air cleaner according to the present invention may be integrally used or separately used as occasion demands. Further, some elements may be omitted according to the usage of the humidification module.

Hereinafter, a humidification module for an air cleaner capable of preventing leakage of water according to an embodiment of the present invention will be described in detail with reference to FIGS. 1 to 5.

Figure 1:
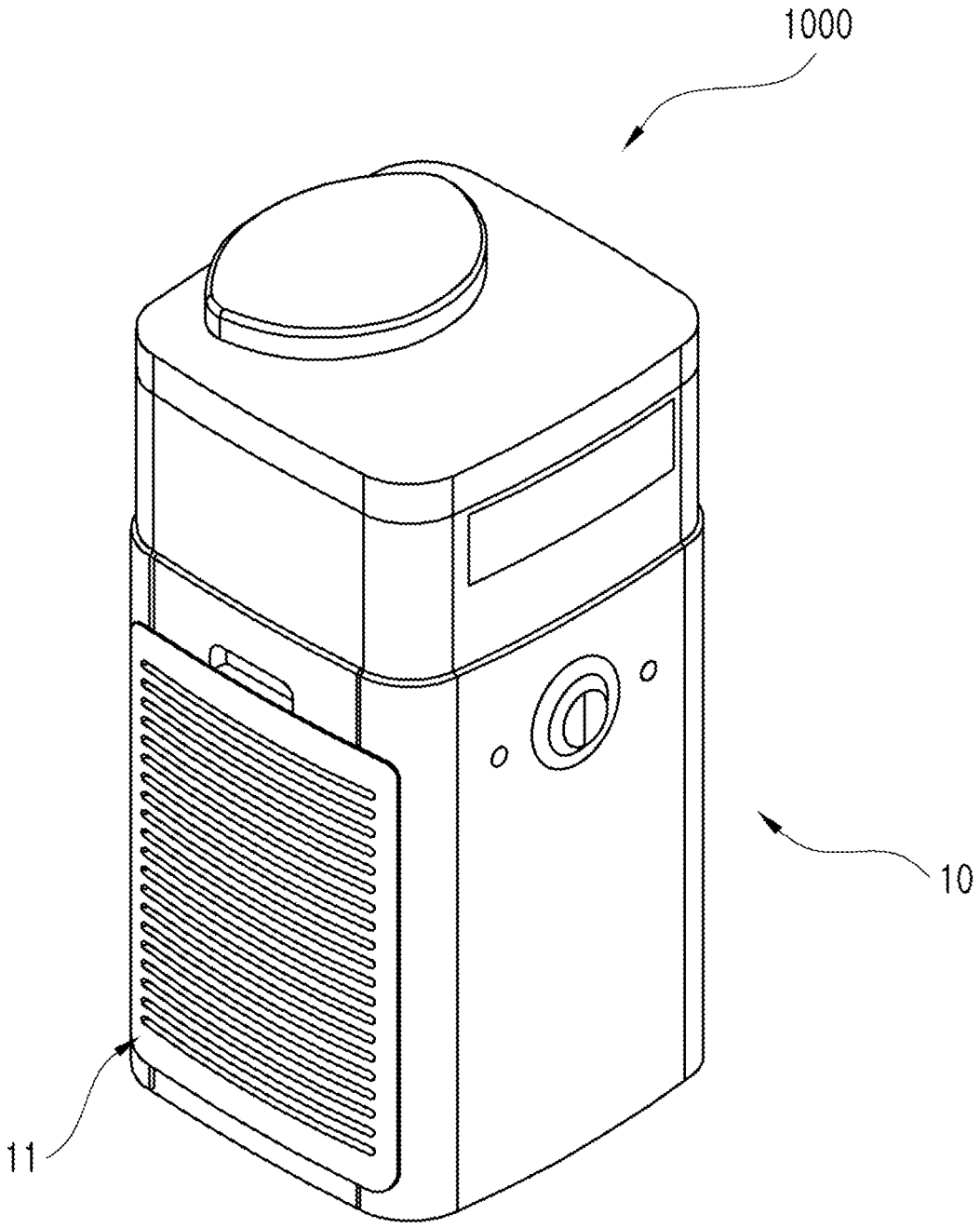
FIG. 1 is a perspective view illustrating a state in which a powerless humidification module for an air cleaner capable of preventing leakage of water is installed in an air cleaner according to an embodiment of the present invention.

A powerless humidification module for an air cleaner capable of preventing leakage of water (hereinafter, simply referred to as a 'humidification module') according to the present invention, as illustrated in FIG. 1, is a powerless humidification module 1000 that may be attached to and detached from an upper portion of the body of an air cleaner 10 to humidify air that is suctioned through a suction hole 11 of the air cleaner, is purified, and is discharged to the upper side.

Figure 2:
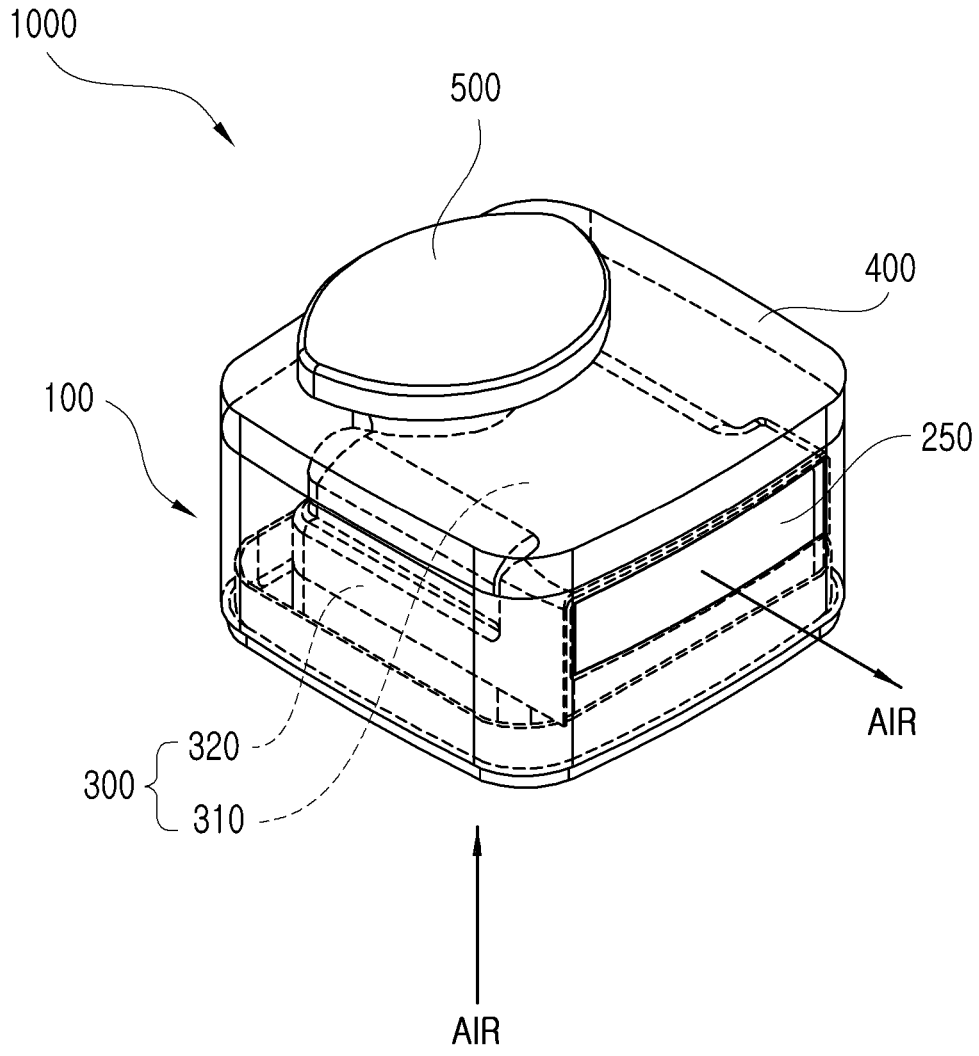
FIG. 2 is a perspective view of a powerless humidification module for an air cleaner capable of preventing leakage of water according to an embodiment of the present invention.
Figure 3:
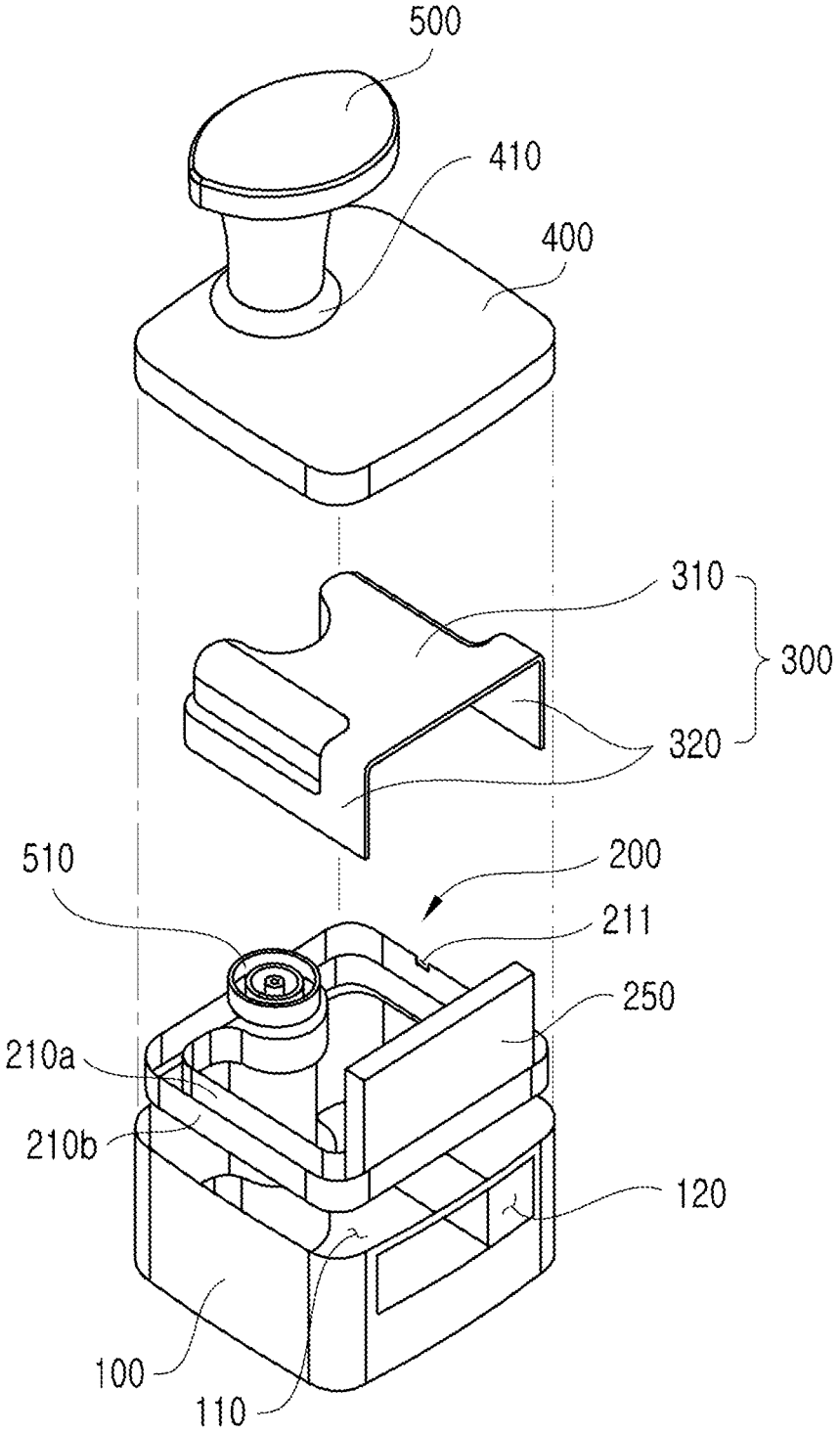
FIG. 3 is an exploded perspective view of the powerless humidification module for an air cleaner capable of preventing leakage of water according to the embodiment of the present invention.

As illustrated in FIGS. 2 and 3, the powerless humidification module 1000 according to the embodiment of the present invention includes a base cover 100, a cistern part 200, a humidification filter 250, and a protector 300.

The base cover 100 may be located to be attached to and detached from the upper side of the air cleaner 10 and may have a first opening 110 and a second opening 120, and a cover part 400 that covers the opened upper portion of the base cover 100 may be located in the base cover 100.

The opening 110 is located on the lower side of the base cover 100 and is opened toward an air discharge part (not illustrated) formed on the upper side of the air cleaner 100, and thus the air discharged from the upper side of the air cleaner 10 is introduced through the first opening 110.

The second opening 120 is opened toward one side surface of the first cover 100, that is, a side surface of the first opening 110, and the air introduced from the air cleaner through the first opening 110 is discharged to the outside through the second opening 120.

The cistern part 200 is located inside the base cover 100, and water is supplied to one side of the cistern part 200.

The cistern part 200 has a space between partition walls 210*a* and 210*b* having predetermined heights such that the supplied water is stored, and the formed space is located to surround a periphery of the first opening 110.

Further, an overflow recess 211 formed to be recessed is formed on one side of an outer partition wall 210*b* of the cistern part 200.

A water tank 500 may be provided on one side of the cistern part 200 through a through-hole 410 formed in the cover part 400 such that the water accommodated in the water tank 500 is supplied to one side of the cistern part 200, but the present invention is not limited thereto and, for example, water may be supplied directly to one side of the cistern part 200 through the through hole 410.

When water is supplied to one side of the cistern part 200 through the water tank 500, an injection cap 510 installed in an entrance of the water tank 500 may be provided.

The humidification filter 250 is located in the second opening 120 of the base cover 100. In detail, a lower side of the humidification filter 250 is inserted into a space formed on the side of the second opening 120 of the cistern part 200, and includes a material that can absorb and contain the water.

Accordingly, the lower side of the humidification filter 250 is immersed in the water supplied to the cistern part 200, and humidification is performed as the air discharged from the air cleaner 10 and introduced through the first opening 110 is discharged to the outside through the second opening 120 in a state in which the humidity of the air is increased while the air passes through the humidification filter 250 immersed in the water (see FIG. 2).

In this way, the water supplied to the cistern part 200 can be prevented from being introduced into the air cleaner 10 through the discharge part of the air cleaner 10 by disposing the cistern part 200, in which the space to which water is supplied is formed between the partition walls 210*a* and 210*b*, surrounds the circumference of the first opening 110 communicated with the discharge part, through which the air is discharged from the air cleaner 10.

Figure 4:
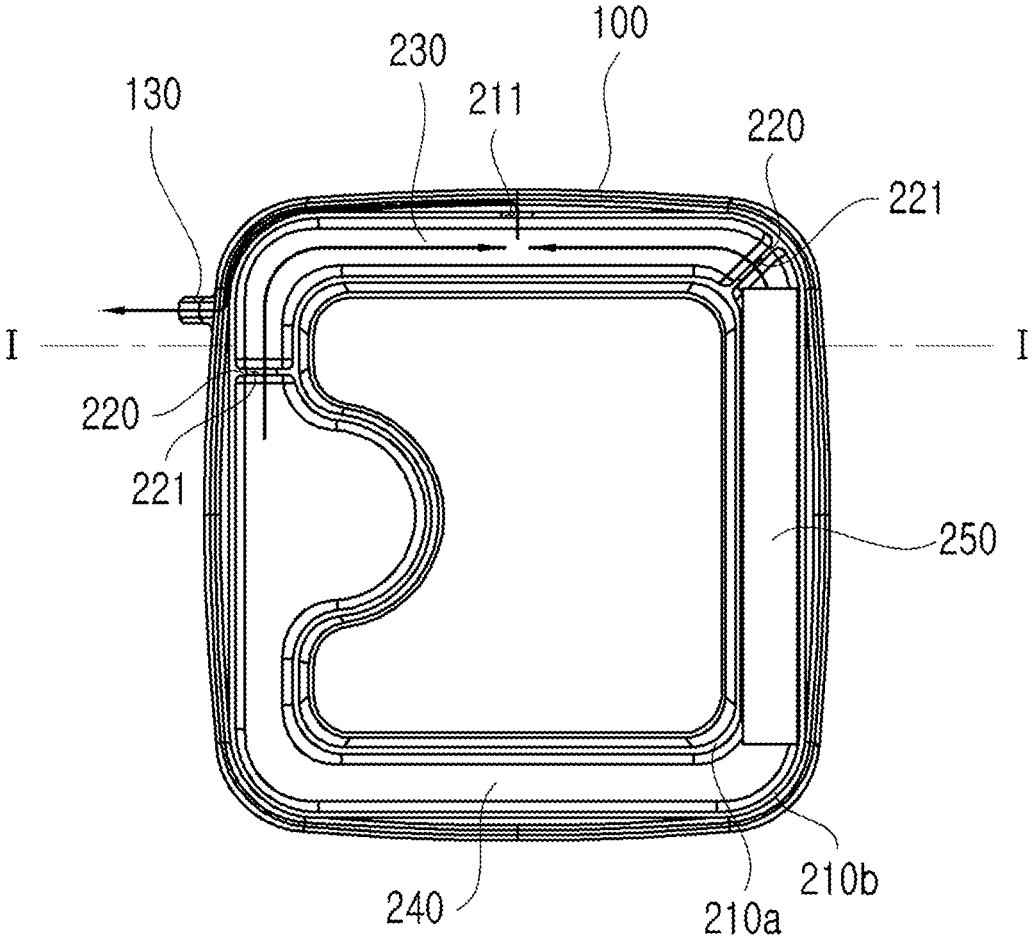
FIG. 4 is a plan view illustrating a base cover and a cistern part of the powerless humidification module for an air cleaner capable of preventing leakage of water according to the present invention, when viewed from the top.

Further, as illustrated in FIG. 4, a partition wall 220 may be provided in the cistern part 200. A plurality of partition walls 220 are formed to have a predetermined height such that the space of the cistern part 200, in which the water is stored, is divided into two parts, and accordingly, the space of the cistern part 200 is divided into one side space 230 and an opposite side space 240 and the part in which the water is supplied and the humidification filter 250 are located in the one side space 230.

Further, a recessed overflow recess 221 is formed in the partition wall 220.

Accordingly, the humidification filter 250 is immersed in the water supplied to the one side space 230 of the cistern part 200, and if the water supplied to the one side space 230 exceeds the height of the overflow recess 221 located in the partition wall 220, the water overflows the partition wall 220 through the overflow recess 221 and is introduced into the opposite side space 240 of the cistern part 200.

Accordingly, the water supplied to the cistern part 200 can be prevented from being introduced into the interior of the air cleaner 10 and the water level of a part in which the humidification filter 250 is immersed can be constantly adjusted.

The protector 300 is located inside the base cover 100 to communicate the first opening 110 and the second opening 120 formed in the base cover 100, and is located to cover an upper side of the first opening 110 through the upper prevention wall 310 located on the upper side of the first opening 110.

That is, the upper prevention wall 310 is spaced apart from the first opening 110 by a predetermined interval to cover the upper side of the first opening 110, and the first opening 110 and the second opening 120 are located to communicate with each other.

In this way, when the water tank 500 is installed from the upper side of the humidification module 1000 to the cistern part 200, the water leaked from the opened injection hole located below the water tank 500 or the water directly supplied from the upper side of the humidification module 100 may be introduced into the air cleaner 10 through the first opening 110, and because the protector 300 is provided, the water can be prevented from being introduced into the interior of the air cleaner 10 when the water tank 500 is coupled or water is directly supplied.

Further, the protector 300 includes a guide wall 320 that extends from an outer periphery of the upper prevention wall 310 to the lower side.

The guide wall 320 extends from the outer periphery of the upper prevention wall 310 to the space of the cistern part 200, to which the water is supplied.

In detail, the guide wall 320 extends from an outer periphery of the upper prevention wall 310 to the lower side, and extends continuously with the space of the cistern part 200, in detail, the inner partition wall 210*a* of the cistern part 200.

Accordingly, as descried above, the introduction of the water leaked in the upper prevention wall 310 can be prevented by the upper prevention wall 310 and the introduction of the water into the air cleaner 10 can be prevented by the cistern part 200 as well, and the leaked water can be introduced into the cistern part 200 along the guide wall 320 to be used for humidification through the humidification filter 250.

Further, the guide wall 320 may extend from an outer periphery of the upper prevention wall 310, except for the second opening 120, to be continuous with the inner partition wall 210*a* that defines the space of the cistern part 200.

Accordingly, the flows of the air through the second opening 120 can be made smoother, and a portion of the leaked water can be directly absorbed by the humidification filter 250 to be used for humidification.

Figure 5:
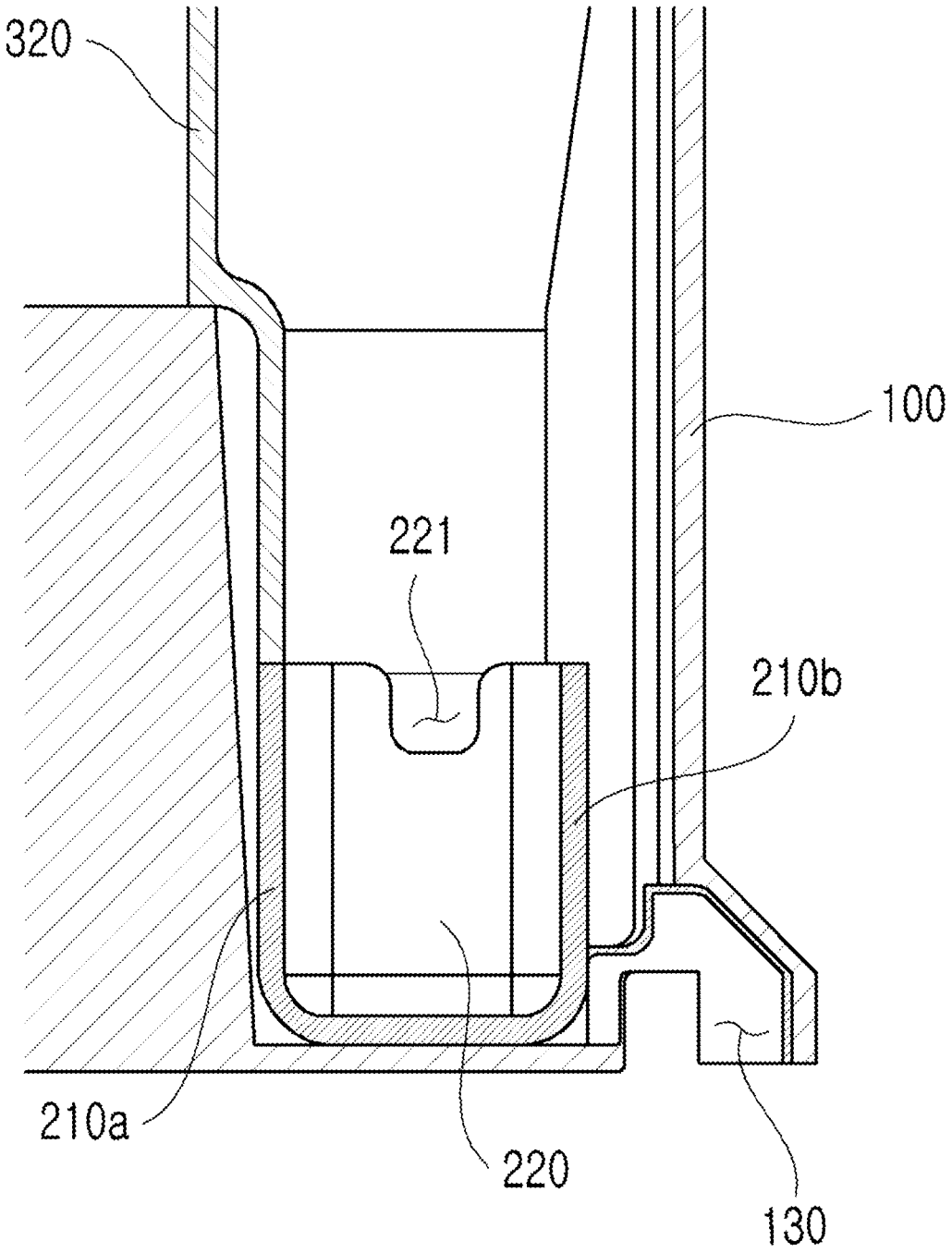
FIG. 5 is a sectional view taken along a line I-I of FIG. 4.

As illustrated in FIGS. 4 and 5, a drain hole 130 may be formed on one side of the base cover 100.

The drain hole 130 is formed by opening a lower portion of one side of the base cover 100, and if the supplied water overflows the height of the overflow recess 211 formed in the outer partition wall 210*b* of the cistern part 200 and is introduced, the overflowing water overflows the outer partition wall 210*b* and flows between the inner peripheral surface of the base cover 100 and the outer partition wall 210*b* of the cistern part 200 through the overflow recess 211 and is discharged to the humidification module 1000 through the drain hole 130.

Further, when the partition wall 220 is provided in the cistern part 200 to divide the space of the cistern part 200, and if the water introduced from one side of the cistern part 200 into the opposite side space 240 of the cistern part 200 after overflowing the partition wall 220 overflows the height of the overflow recess 211 formed in the outer partition wall 210*b*, the overflowing water flows to the base cover 100, after overflowing the outer partition wall 210*b* through the overflow recess 211 and is discharged through the drain hole 130 (see the arrow of FIG. 5).

Accordingly, the water in the cistern part 200 can be prevented from being introduced into the interior of the air cleaner 10 by two stages.

Further, a sensor (not illustrated) that detects the level of the water stored in the space of the cistern part 200 is further provided, and if the water introduced into the space of the cistern part 200 is detected to be a predetermined height or more, it may be displayed through a display unit (not illustrated) connected to the sensor.

Meanwhile, an opening/closing unit (not illustrated) may be provided on the side of the drain hole 130, and if the sensor detects that the level of the water is a predetermined height or more, the opening/closing unit can be opened such that the water introduced to the base cover 100, after overflowing the outer partition wall 210*b* of the cistern part 200 can be discharged.

As described above, according to the powerless humidification module for an air cleaner that may prevent leakage of water according to the present invention, overflowing of water into the interior of the air cleaner and introduction of water when the water is supplied can be prevented, a predetermined amount of water that is necessary for humidification can be adjusted, and the humidification module can be easily attached to and detached from the air cleaner.

Although the preferred embodiments of the present invention have been described, the present invention is not limited to the embodiments. That is, it should be understood that an ordinary person in the art to which the present invention pertains can variously change and modify the present invention without departing from the spirit and scope of the claims and all the changes and equivalents also fall within the scope of the present invention.

DESCRIPTION OF REFERENCE NUMERALS

10: air cleaner
100: base cover
110: first opening
120: second opening
200: cistern part
210*a*, 210*b*: partition wall
220: partition wall
300: protector
310: upper prevention wall
320: guide wall
400: cover
500: water tank

The invention claimed is:

1. A powerless humidification module for an air cleaner which is detachably mounted on an upper portion of a body of the air cleaner and is capable of preventing leakage of water, humidification module comprising:

a base cover having a first opening opened toward the air cleaner and a second opening opened toward a side surface of the first opening;

a cistern part located in an interior of the base cover and comprising an inner partition wall and an outer partition wall having predetermined heights, wherein a space, in which water supplied to the space is stored and which surrounds a periphery of the first opening, is formed between the inner partition wall and the outer partition;

a humidification filter located in the second opening and located in the space of the cistern part; and a protector located in the interior of the base cover to communicate the first opening and the second opening and located to cover an upper portion of the first opening, wherein the protector comprises:

an upper prevention wall located to cover the upper portion of the first opening; and a guide wall extending from an outer periphery of the upper prevention wall to the space of the cistern part;

wherein the humidification module further comprises:

a water tank located above the upper prevention wall, wherein the water tank communicates with an injection cap located in the space of the cistern part, and water leaked while moving from the water tank to the injection cap flows into the guide wall of the protector.

2. The humidification module of claim 1, further comprising:

a drain hole formed on one side of the base cover, wherein when the water supplied to one side space of the cistern part overflows a predetermined height of an overflow recess formed in the outer partition wall, the water is discharged through the drain hole, overflowing the outer partition wall through the overflow recess.

3. The humidification module of claim 1, further comprising:

a partition wall which has a height such that the space, in which the water of the cistern part is stored, is divided into one side space and an opposite side space, wherein when the water supplied to one side space of the cistern part overflows a predetermined height of an overflow recess formed in the partition wall, the water is introduced into the opposite side space of the cistern part, overflowing the partition wall through the overflow recess.

4. The humidification module of claim 3, further comprising:

a drain hole formed on one side of the base cover, wherein when the water introduced to the opposite side space of the cistern part overflows a predetermined height of an overflow recess formed in the outer partition wall, the water is discharged through the drain hole overflowing the outer partition wall through the overflow recess.

5. The humidification module of claim 1, further comprising:

a sensor configured to detect the level of the water stored in the space of the cistern part.

6. The humidification module of claim 2, further comprising:

a sensor configured to detect the level of the water stored in the space of the cistern part.

7. The humidification module of claim 3, further comprising:

a sensor configured to detect the level of the water stored in the space of the cistern part.

8. The humidification module of claim 4, further comprising:

a sensor configured to detect the level of the water stored in the space of the cistern part.

* * * * *